US007586503B2

(12) United States Patent
Leigh et al.

(10) Patent No.: US 7,586,503 B2
(45) Date of Patent: Sep. 8, 2009

(54) REDUCING ACOUSTICAL NOISE IN DIFFERENTLY AIMING SUB-FRAMES OF IMAGE DATA FRAME

(75) Inventors: Stan E. Leigh, Corvallis, OR (US); Arnold W. Larson, Corvallis, OR (US); P. Guy Howard, Junction City, OR (US); Ted W. Barnes, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 783 days.

(21) Appl. No.: 11/193,888

(22) Filed: Jul. 30, 2005

(65) Prior Publication Data

US 2007/0024548 A1 Feb. 1, 2007

(51) Int. Cl.
*G09G 5/10* (2006.01)

(52) U.S. Cl. ..... 345/690; 345/696; 345/697; 345/698

(58) Field of Classification Search ..... 345/690, 345/696–698
See application file for complete search history.

(56) References Cited

U.S. PATENT DOCUMENTS

| | | | | |
|---|---|---|---|---|
| 5,789,870 | A | 8/1998 | Remson | |
| 2004/0027363 | A1 * | 2/2004 | Allen | 345/698 |
| 2004/0148579 | A1 | 7/2004 | Visweswariah | |
| 2004/0251940 | A1 | 12/2004 | Hayashi et al. | |

OTHER PUBLICATIONS

Don, Alfano, Suppresing Acoustical noise in PMW fan speed control system, Mar. 4, 1998, TellCom Semiconductor, Inc.*

Don Alfano, TelCom Semiconductor Application Note 58: Suppressing acoustic noise in PWM fan speed control Systems, Mar. 4, 1998.

Durel Corporation, Durel Backlight IC Driver Product Selector Guide, copyright 1999-2003.

* cited by examiner

*Primary Examiner*—Richard Hjerpe
*Assistant Examiner*—Leonid Shapiro

(57) ABSTRACT

A modulator is controlled in accordance with each sub-frame of a frame of image data. An aiming mechanism is physically adjusted to differently aim each sub-frame. Acoustical noise in physically adjusting the aiming mechanism is reduced.

25 Claims, 5 Drawing Sheets

REDUCING ACOUSTICAL NOISE IN DIFFERENTLY AIMING SUB-FRAMES OF IMAGE DATA FRAME

BACKGROUND

Some types of display devices, such as projectors, employ light modulators like digital micromirror devices (DMD's) to modulate light in accordance with image data. A light modulator like a DMD has a given resolution of pixel areas, and generally the resolution of the display device itself matches the resolution of the DMD or other light modulator that it uses. However, more recently a technique has been introduced in which the resolution of the display device is increased beyond the resolution of its DMD or other light modulator.

For instance, a mirror or lens may be moved back and forth to direct the light modulated by the DMD or other light modulator in different directions, so that a given pixel area of the DMD or other light modulator can be used for more than one pixel of the display device. The patent application entitled "Image Display System and Method," filed on Sep. 11, 2002, and published as U.S. patent application publication no. 2004/0027363, describes such an approach to increasing the resolution of a display device over that of its DMD or other light modulator. However, the back-and-forth movement of the mirror or lens can cause undesired acoustical noise.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated, and implications to the contrary are otherwise not to be made.

DETAILED DESCRIPTION OF THE DRAWINGS

In the following detailed description of exemplary embodiments of the invention, reference is made to the accompanying drawings that form a part thereof, and in which is shown by way of illustration specific exemplary embodiments in which the invention may be practiced. These embodiments are described in sufficient detail to enable those skilled in the art to practice the invention. Other embodiments may be utilized, and logical, mechanical, electrical, electro-optical, software/firmware and other changes may be made without departing from the spirit or scope of the present invention. The following detailed description is, therefore, not to be taken in a limiting sense, and the scope of the present invention is defined only by the appended claims.

Figure 1:
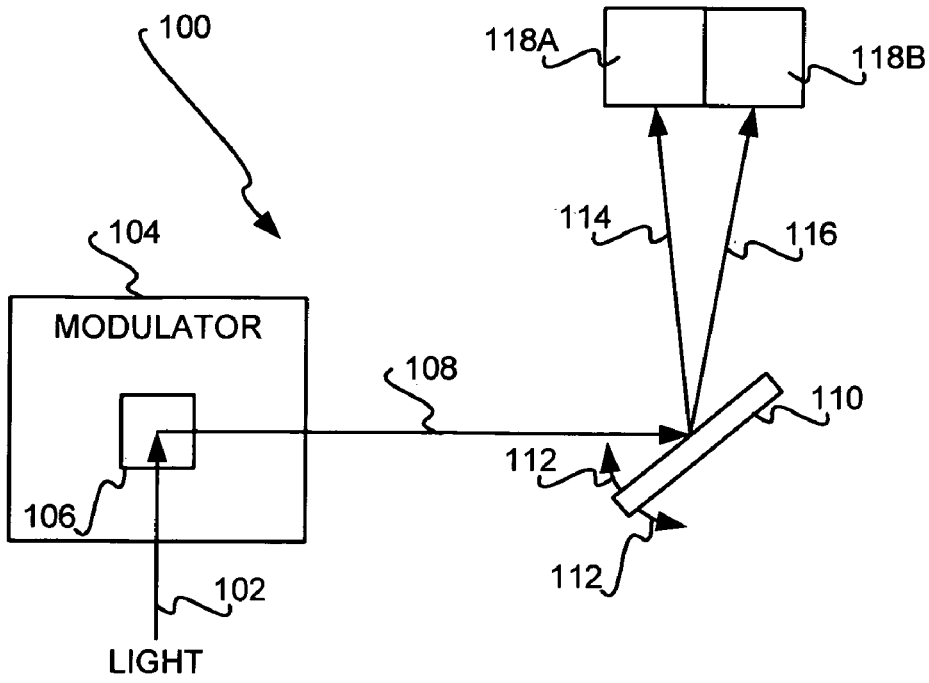
FIG. 1 is a diagram of the general approach by which a modulator having a given resolution can be employed to yield the display of image data with a greater resolution by using a physically adjustable aiming mechanism, according to an embodiment of the invention.

FIG. 1 shows a general approach 100 by which a light modulator 104 having a given resolution can be employed to yield the display of image data with a greater resolution, according to an embodiment of the invention. The approach 100 is exemplarily described in relation to a single pixel area 106 of the modulator 104. However, the approach 100 is the same for all the pixels of the modulator 104. Furthermore, the approach 100 may be that which is more particularly described in the patent application entitled "Image Display System and Method," filed on Sep. 11, 2002, and published as U.S. patent application publication no. 2004/0027363.

Light is directed towards the modulator 104, as indicated by the arrow 102. The modulator 104 may be a digital micromirror device (DMD), or another type of light modulator. The pixel area 106 of the modulator 104 specifically modulates the light in accordance with either a first pixel or a second pixel of image data. The pixel area 106 may correspond to an individual micromirror within a DMD, for instance. The light as modulated by the pixel area 106 is directed towards an aiming mechanism 110, as indicated by the arrow 108. The aiming mechanism 110 may be or include a mirror, a lens, a refractive plate of refractory glass, or another type of aiming mechanism. The aiming mechanism 110 is able to move back and forth, as indicated by the arrows 112. That is, the aiming mechanism 110 is able to be physically adjusted. As depicted in FIG. 1, the aiming mechanism 110 is reflective, but can also be refractive. That is, the aiming mechanism 110 may be a reflective aiming mechanism, or a refractive aiming mechanism. The aiming mechanism 110 may alternatively be referred to as an image shifter, or an image-shifting mechanism.

When the pixel area 106 has modulated the light in accordance with the first pixel of the image data, the aiming mechanism 110 directs the light to the position 118A, as indicated by the arrow 114. When the pixel area 106 has modulated the light in accordance with the second pixel of the image data, the aiming mechanism 110 directs the light to the position 118B, as indicated by the arrow 114. The positions 118A and 118B, collectively referred to as the positions 118, are depicted in FIG. 1 as being adjacent positions, but in other embodiments may be non-adjacent, or may be overlapping.

Physically adjusting the aiming mechanism 110 depending on the pixel of the image data in accordance with which the pixel area 106 of the modulator 104 is currently modulating the light allows the pixel area 106 to be used for more than one pixel of the image data. With respect to all the pixel areas of the modulator 104, this approach 100 allows for the display of image data with greater resolution than the number of pixel areas of the modulator 104 itself. The approach 100 has been described in relation to the pixel area 106 being able to be used for two pixels. However, in other embodiments, the approach 100 may be used so that each pixel area of the modulator 104 can be used for more than two pixels.

Furthermore, the pixel area 106 may modulate the light in accordance with elements of the image data other than individual pixels. For instance, the pixel area 106 may modulate the light in accordance with a first sub-pixel of a given pixel, and then modulate the light in accordance with a second sub-pixel of the same pixel. In such an embodiment, the aiming mechanism 110 may direct the light as modulated by the pixel area 106 in accordance with the first sub-pixel to the position 118A, and direct the light as modulated by the pixel area 106 in accordance with the second sub-pixel to the position 118B.

Figure 2:
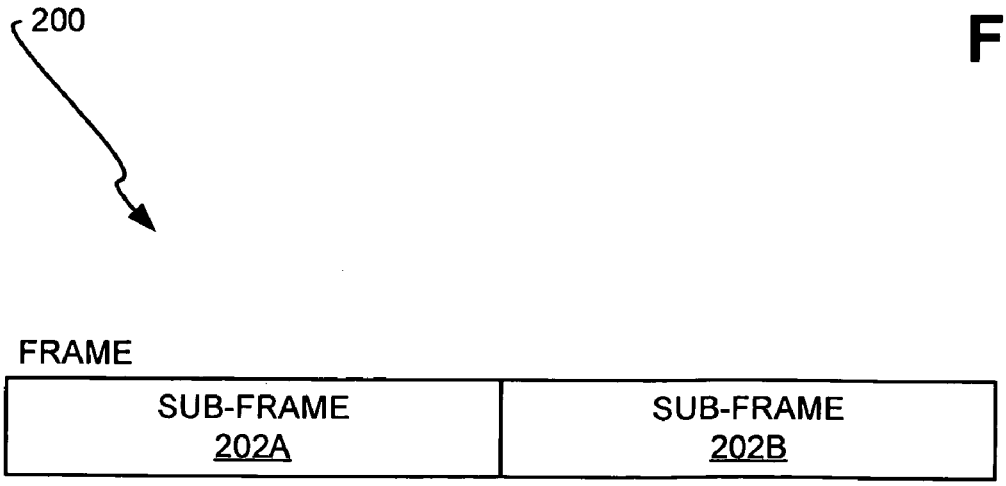
FIG. 2 is a diagram of a frame of image data divided into two sub-frames, according to an embodiment of the invention.

FIG. 2 shows a representative frame 200 of image data that can be used in conjunction with the approach 100 of FIG. 1, according to an embodiment of the invention. The frame 200 is divided into a first sub-frame 202A and a second sub-frame 202B, collectively referred to as the sub-frames 202. The sub-frame 202A may in one embodiment contain half of the pixels of the image data, and the sub-frame 202B may contain the other half of the pixels of the image data. In another embodiment, the sub-frame 202A may contain half of the sub-pixels of all the pixels of the image data, and the sub-frame 202B may contain the other half of the sub-pixels of all the pixels of the image data.

With respect to the positions 118 and the pixel area 106 in FIG. 1, the sub-frame 202A contains the part of the image data that the pixel area 106 modulates light in accordance therewith while the aiming mechanism 110 is directing this light onto the position 118A, as indicated by the arrow 114. Similarly, the sub-frame 202B contains the part of the image data that the pixel area 106 modulates light in accordance therewith while the aiming mechanism is directing this light onto the position 118B, as indicated by the arrow 116. Thus, by dividing each frame of the image data into sub-frames, the modulator 104 modulates light in accordance with the different sub-frames as the aiming mechanism 110 directs this modulated light to different positions.

Figure 3:
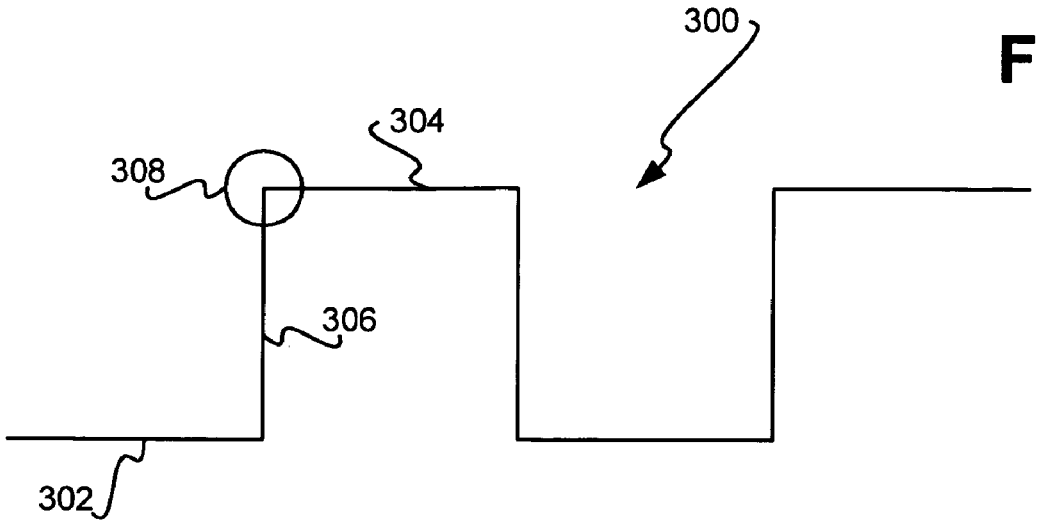
FIG. 3 is a diagram depicting the waveform of a signal for controlling the physical adjustment of an aiming mechanism, which causes acoustical noise in the physical adjustment of the aiming mechanism, according to an embodiment of the invention.

Physically adjusting the aiming mechanism 110 to move the aiming mechanism 110 so that it directs light to different positions can be accomplished by using an actuator, which may be part of the aiming mechanism 110, that is responsive to a signal. FIG. 3 shows an example of a signal 300 that can be used to physically adjust the aiming mechanism 110, according to an embodiment of the invention. The signal 300 has a square wave waveform. The square wave waveform of the signal 300 provides for the best picture quality in using the modulator 104 to display image data with a greater resolution than the number of pixel areas of the modulator 104.

The low portion 302 of the waveform corresponds to the aiming mechanism 110 being moved such that it directs modulated light to one position, while the high portion 304 of the waveform corresponds to the aiming mechanism 110 being moved such that it directs modulated light to another position. For example, the low portion 302 may correspond to the aiming mechanism 110 directing light modulated by the pixel area 106 to the position 118A in FIG. 1. The high portion 304 may correspond to the aiming mechanism 110 directing light modulated by the pixel area 106 to the position 118B in FIG. 1.

The transition 306 between the low portion 302 and the high portion 304 of the waveform of the signal 300 is at a ninety-degree angle, and thus is representative of an impulse function. The transition 306 between the low and high portions 302 and 304 is instantaneous, and therefore is necessarily faster than the slew rate of the aiming mechanism 110. That is, the transition 306 is faster than the maximum rate at which the aiming mechanism 110 can be physically adjusted to move such that it directs light at the position 118B in FIG. 1 instead of the light at the position 118A in FIG. 1, and vice-versa. Having the transition greater than the slew rate of the aiming mechanism 110 results in acoustical noise when physically adjusting the aiming mechanism 110, because the aiming mechanism 110 is attempting to move faster than it is capable of moving.

The corners of the waveform of the signal 300, such as the corner 308, are sharp square corners. Having sharp and/or square corners within the waveform of the signal 300 also results in acoustical noise when physically adjusting the aiming mechanism 110. This is because the sharp and/or square corners of the waveform represent high-frequency energy that reveal itself as acoustical noise as the aiming mechanism 110 is being moved. Thus, while the waveform of the signal 300 provides for optimal image quality, it also provides for a large amount of acoustical noise when physically adjusting the aiming mechanism 110.

Figure 4:
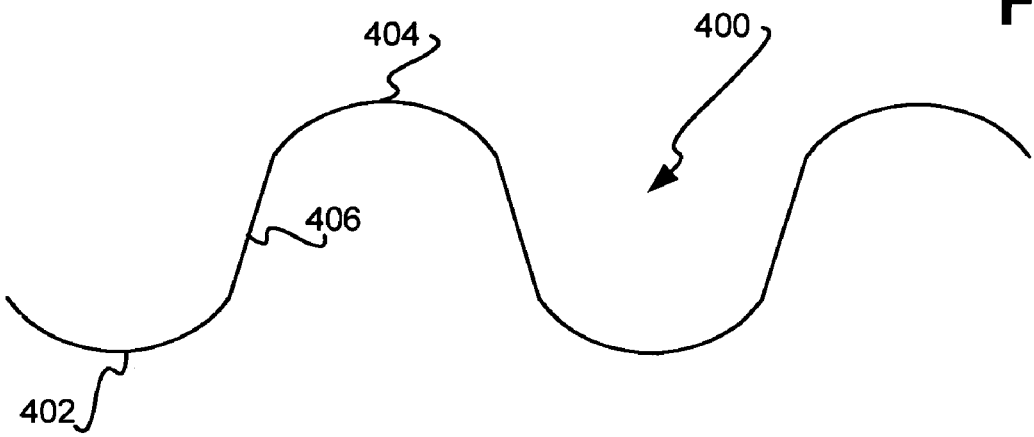
FIG. 4 is a diagram depicting the waveform of a signal for controlling the physical adjustment of an aiming mechanism, which causes little acoustical noise in the physical adjustment of the aiming mechanism but decreases image quality, according to an embodiment of the invention.

FIG. 4 shows an example of another signal 400 that can be used to physically adjust the aiming mechanism 110, according to an embodiment of the invention. The signal 400 has an approximate sine wave waveform. The approximate sine wave waveform of the signal 400 provides for a small amount of acoustical noise in using the modulator 104 to display image data with a greater resolution than the number of pixel areas of the modulator 104. This is because the transition 406 between the low portion 402 and the high portion 404 of the waveform is less than the slew rate of the aiming mechanism 110, and also because there are no corners within the waveform of the signal 400.

However, the waveform of the signal 400 provides for less than optimal image quality. This is because the signal 400 does not result in the aiming mechanism 110 directing modulated light to any given position for any great length of time. For instance, the low portion 402 is reached for only a brief moment in time, before the signal 400 begins the transition 406 upwards to the high portion 404. Therefore, in the context of FIG. 1, the aiming mechanism 110 directs the light modulated by the pixel area 106 to the position 118A for just a correspondingly brief moment in time, which tends to blur the image being displayed.

Similarly, the high portion 404 is reached for only a brief moment in time, also tending to blur the image being displayed, before the signal 400 begins a transition downwards again. Therefore, in the context of FIG. 1, the aiming mechanism 110 directs the light modulated by the pixel area 106 to the position 118B for just a correspondingly brief moment in time. That is, the waveform of the signal 400 is such that most of the time the aiming mechanism 110 is being physically adjusted and thus moving, such that the aiming mechanism 110 does not direct light at any given position for any great length of time.

Figure 5:
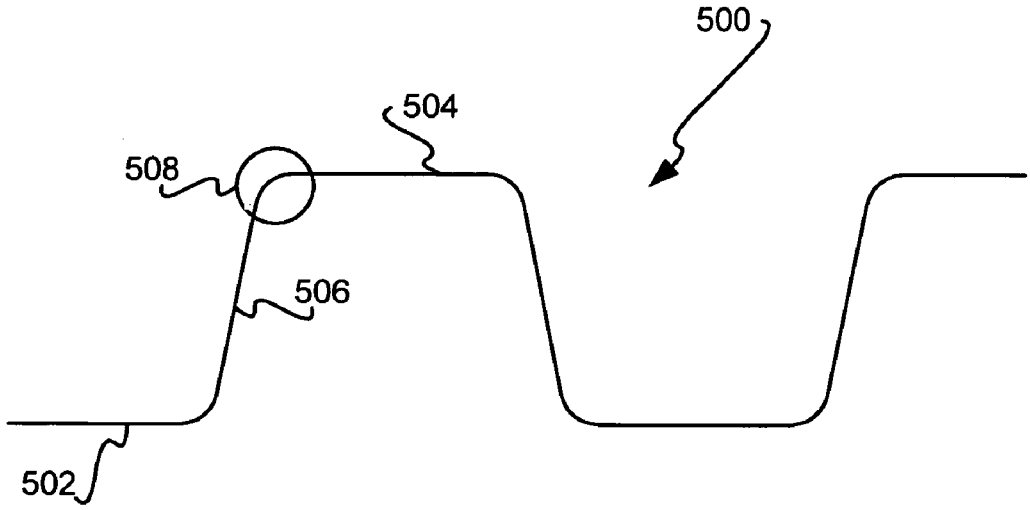
FIG. 5 is a diagram depicting the waveform of a signal for controlling the physical adjustment of an aiming mechanism, which reduces acoustical noise in the physical adjustment of the aiming mechanism with little decrease in image quality, according to an embodiment of the invention.

FIG. 5 shows an example of another signal 500 that can be used to physically adjust the aiming mechanism 110, according to an embodiment of the invention. The waveform of the signal 500 provides a compromise between acoustical noise and image quality. In particular, the waveform of the signal 500 reduces the acoustical noise as compared to the waveform of the signal 300 of FIG. 3, while providing for nearly the same image quality as that of the waveform of the signal 300.

The waveform of the signal 500 has a low portion 502 and a high portion 504 that are maintained for relatively great lengths of time. Thus, the aiming mechanism 110 directs light to given positions for correspondingly great lengths of time, ensuring good image quality. That is, the waveform of the signal 500 is such that a good percentage of the time the aiming mechanism 110 is not being physically adjusted and not moving. For example, the low portion 502 may correspond to the aiming mechanism 110 directing modulated light by the pixel area 106 to the position 118A in FIG. 1, whereas the high portion 504 may correspond to the aiming mechanism 110 directing modulated light by the pixel area 106 to the position 118B in FIG. 1.

Acoustical noise in physically adjusting the aiming mechanism 110 in accordance with the signal 500 is reduced via two features of the waveform of the signal 500. First, the slope of the transition 506 between the low portion 502 and the high portion 504 of the waveform matches the slew rate of the aiming mechanism 110. As a result, the aiming mechanism 110 is not attempted to be moved, or physically adjusted, faster than it can be intrinsically moved, in contradistinction to the waveform of the signal 300 of FIG. 3. Having the transition 506 match the slew rate of the aiming mechanism 110 therefore reduces the noise when physically adjusting the aiming mechanism 110.

Second, corners of the waveform, such as the corner 508, are smoothed, or rounded. The smoothed, or rounded, corners of the waveform decrease the amount of high-frequency energy that reveals itself as acoustical noise. Because the waveform has less high-frequency energy, there is less of such energy to reveal itself as acoustical noise, which also reduces the noise when physically adjusting the aiming mechanism 110.

Figure 6:
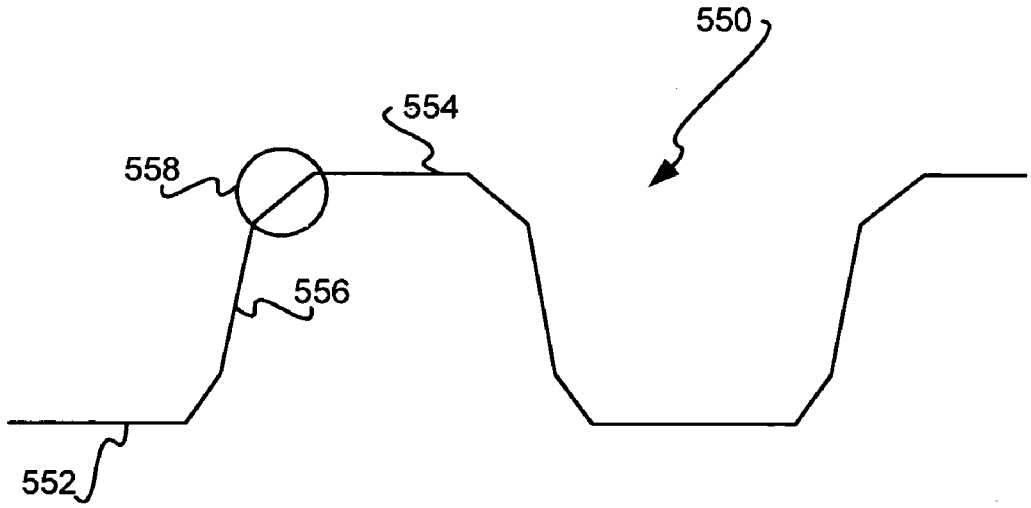
FIG. 6 is a diagram depicting the waveform of a signal for controlling the physical adjustment of an aiming mechanism, which reduces acoustical noise in the physical adjustment of the aiming mechanism with little decrease in image quality, according to another embodiment of the invention.

FIG. 6 shows an example of another signal 550 that can be used to physically adjust the aiming mechanism 110, according to an embodiment of the invention. The waveform of the signal 550, like that of the signal 500 of FIG. 5, provides a compromise between acoustical noise and image quality. The waveform of the signal 550 reduces the acoustical noise as compared to the waveform of the signal 300 of FIG. 3, while providing for nearly the same image quality as that of the waveform of the signal 300.

The waveform of the signal 550 has a low portion 552 and a high portion 554 that are maintained for relatively great lengths of time. Thus, the aiming mechanism 110 directs light to given positions for correspondingly great lengths of time, ensuring good image quality, as has been described in relation to the signal 500 of FIG. 5. That is, the waveform of the signal 550 is such that a good percentage of the time the aiming mechanism 110 is not being physically adjusted and not moving.

Acoustical noise in physically adjusting the aiming mechanism 110 in accordance with the signal 550 is reduced via two features of the waveform of the signal 550. First, the slope of the transition 556 between the low portion 552 and the high portion 554 of the waveform matches the slew rate of the aiming mechanism 110. Thus, acoustical noise is reduced in the same way as has been described in relation to FIG. 5, in which the slope of the transition 506 of the waveform of the signal 500 of FIG. 5 matches the slew rate of the aiming mechanism 110.

Second, corners of the waveform, such as the corner 558, are cut off, such as a straight line cut off as is specifically depicted in FIG. 6. The cut-off corners decrease the amount of high-frequency energy that reveals itself as acoustical noise. Because the waveform has less high-frequency energy, there is less of such energy to reveal itself as acoustical noise, which also reduces the noise when physically adjusting the aiming mechanism 110.

In general, then, reducing acoustical noise when physically adjusting the aiming mechanism 110 is achieved in at least one of two ways. First, the transitions between low portions and high portions of the waveform of the signal driving the aiming mechanism 110 are to have slopes that are no greater than the slew rate of the aiming mechanism 110, and can indeed match the slew rate of the aiming mechanism 110. Second, the corners of the waveform of this signal are softened, such as by smoothing, rounding, or cutting off the corners.

Figure 7A:
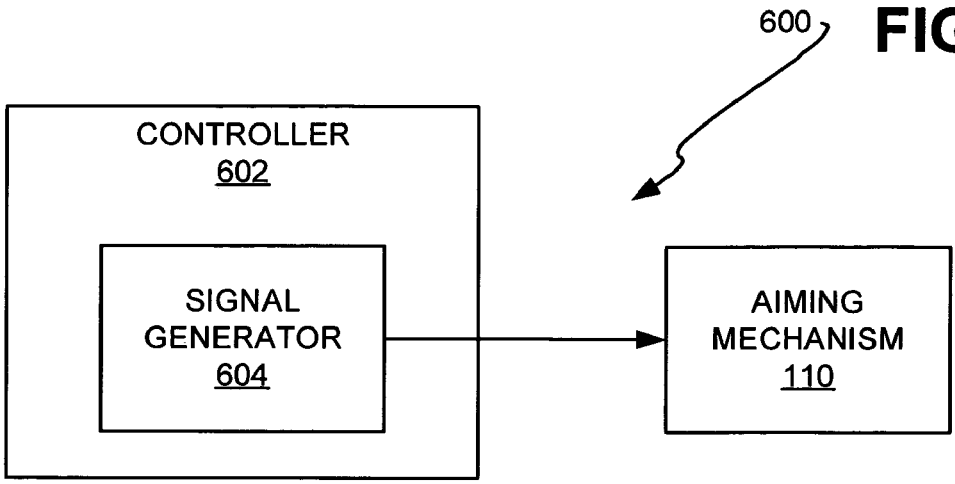
FIGS. 7A and 7B are diagrams of an aiming sub-system having an aiming mechanism that is physically adjustable, according to different embodiments of the invention.
Figure 7B:
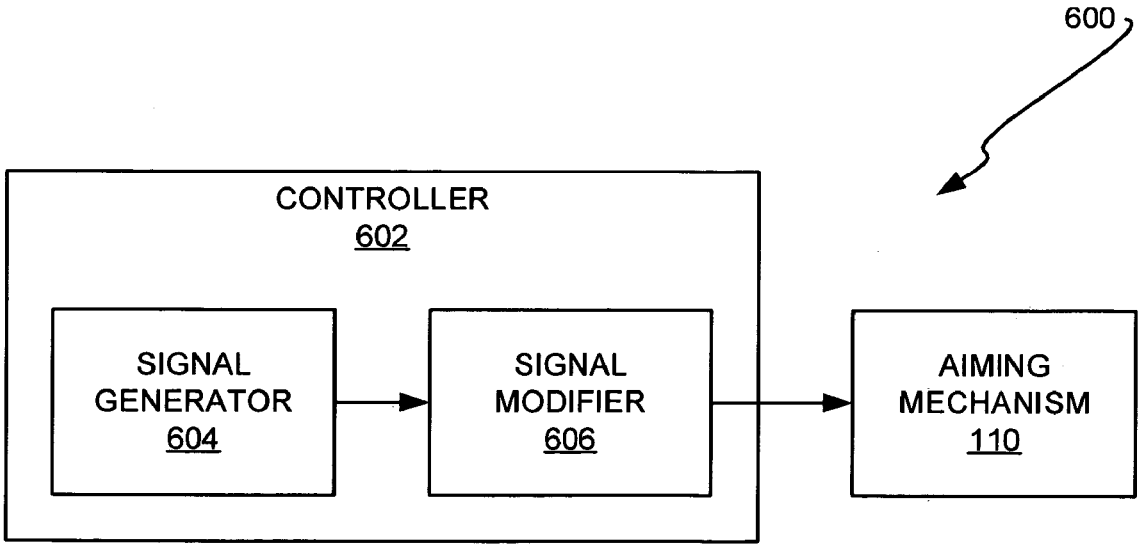

FIGS. 7A and 7B show an aiming sub-system 600, according to different embodiments of the invention. In both FIGS. 7A and 7B, the aiming sub-system 600 includes a controller 602 and the aiming mechanism 110. As has been described, the aiming mechanism 110 differently aims light modulated in accordance with each sub-frame of each frame of image data to a different position. The aiming mechanism 110 may be a mirror and/or a lens.

The controller 602 physically adjusts the aiming mechanism 110 such that acoustical noise is reduced. For example, in one embodiment, the controller 602 physically adjusts the aiming mechanism 110 in accordance with the signal 500 of FIG. 5 that has been described. The controller 602 may be implemented in software, hardware, or a combination of software and hardware. As can be appreciated by those of ordinary skill within the art, the controller 602 and/or the sub-system 600 may include components in addition to and/or in lieu of those depicted in FIGS. 7A and 7B. For instance, there may be an amplifier to amplify the signal 500 for controlling the aiming mechanism 110, which may be a part of the controller 602 or a part separate from the controller 602.

In FIG. 7A, the controller 602 includes a signal generator 604. The signal generator 604 in FIG. 7A specifically generates the signal that controls physical adjustment of the aiming mechanism 110 such that acoustical noise is reduced. For instance, the signal generator 604 in FIG. 7A may generate the signal 500 of FIG. 5 that has been described.

In FIG. 7B, the controller 602 includes a signal modifier 606 in additional to the signal generator 604. The signal generator 604 in FIG. 7B generates a signal for controlling physical adjustment of the aiming mechanism 110. However, the signal is first passed through the signal modifier 606, which modifies the signal to reduce acoustical noise when physically adjusting the aiming mechanism 110.

For example, the signal generator 604 in FIG. 7B may generate the signal 300 of FIG. 3 that has been described. The signal modifier 606 may then modify the signal 300 so that it results in the signal 500 of FIG. 5. That is, the signal modifier 606 softens the corners of the waveform of the signal 300, and decreases the slope of the transition of the signal 300. The signal modifier 606 may be an analog filter, or a digital signal processor (DSP) in varying embodiments of the invention. In both FIGS. 7A and 7B, the aiming sub-system 600 may include components in addition to those that are depicted and that have been described.

Figure 8:
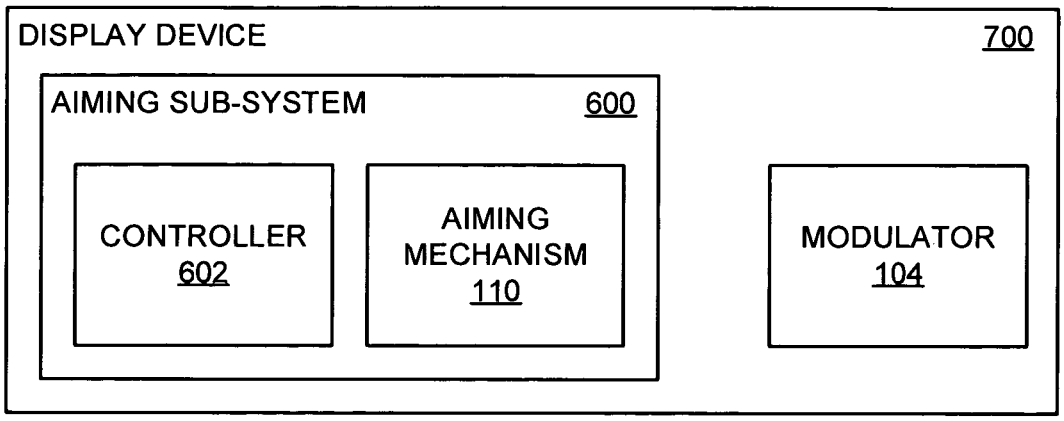
FIG. 8 is a block diagram of a rudimentary display device, such as a projector, according to an embodiment of the invention.

FIG. 8 shows a rudimentary display device 700, according to an embodiment of the invention. The display device 700 may be a front or rear projector, for instance. The display device 700 includes the aiming sub-system 600 and the modulator 104 that have been described, where the aiming sub-system 600 includes the controller 602 and the aiming mechanism 110. As can be appreciated by those of ordinary skill within the art, the display device 700 may include components in addition to those depicted in FIG. 8.

Figure 9:
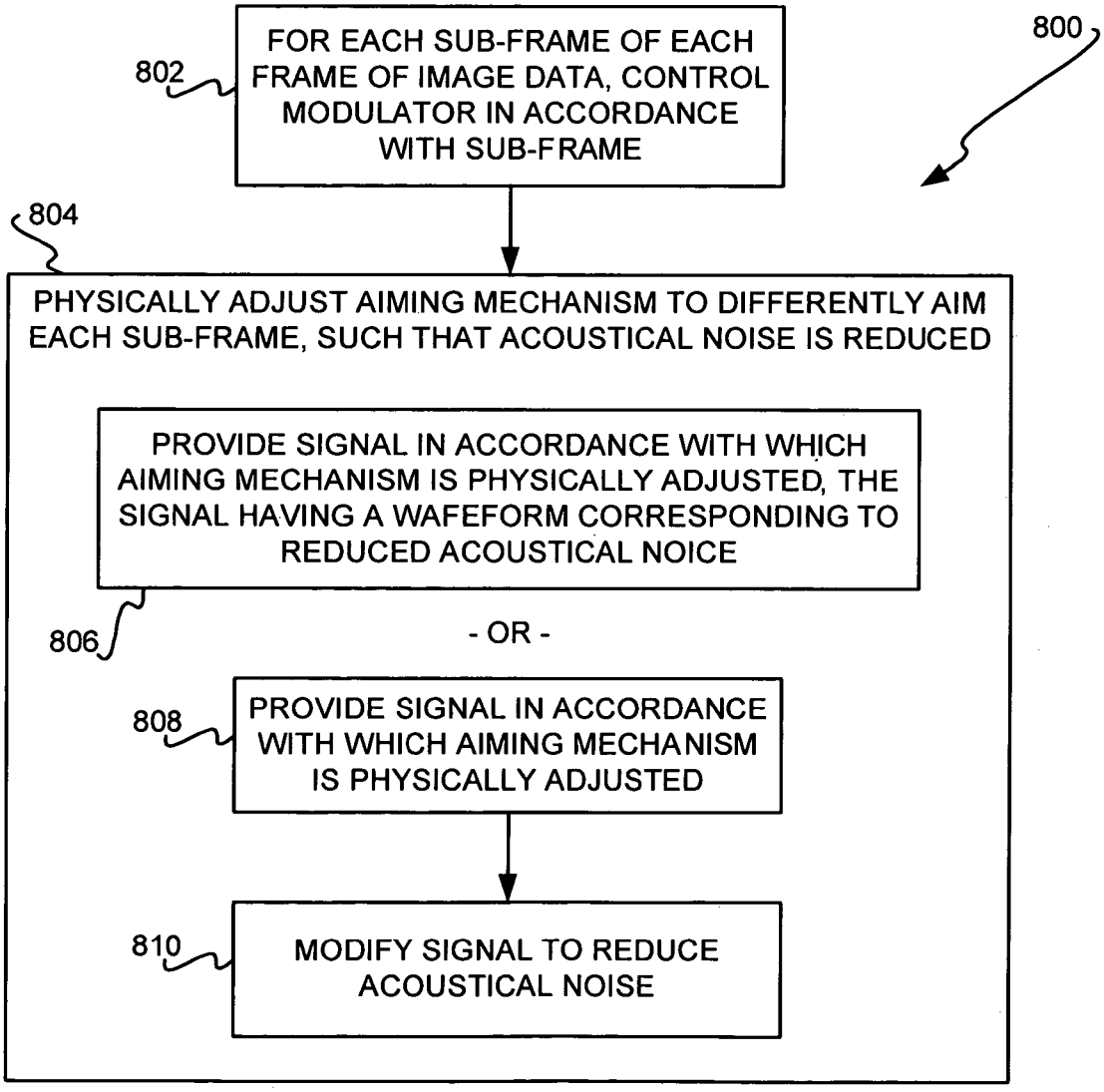
FIG. 9 is a flowchart of a method for using a modulator having a given resolution to display image data with a greater resolution by using a physical adjustable aiming mechanism, according to an embodiment of the invention.

FIG. 9 shows a method 800 for achieving a greater resolution in displaying image data than the resolution of the modulator 104, according to an embodiment of the invention. For each sub-frame of each frame of image data, the modulator 104 is controlled in accordance with the sub-frame (802). The aiming mechanism 110 is physically adjusted to differently aim the display of each sub-frame to a different position, while reducing acoustical noise (804).

The physical adjustment of the aiming mechanism 110 in 804 may be accomplished in one of at least two different ways. First, a signal may be provided in accordance with which the aiming mechanism 110 is physically adjusted and that has a waveform corresponding to reduced acoustical noise (806). For instance, the signal that is provided in 806 may be the signal 500 of FIG. 5. That is, a signal may be provided in which corners of the waveform thereof are smoothed, and the transition between low and high portions of the waveform at least substantially matches the slew rate of the aiming mechanism 110. Performing 806 can correspond to the embodiment of FIG. 7A.

Second, a signal may be provided in accordance with which the aiming mechanism 110 is physically adjusted (808), and then the signal may be modified to reduce acoustical noise when the aiming mechanism 110 is physically adjusted in accordance therewith (810). For instance, the signal that is provided in 808 may be the signal 300 of FIG. 3, which is then modified in 810 to result in the signal 500 of FIG. 5. That is, the corners of the waveform of the signal 300 are smoothed, and the transitions between low and high portions of the waveform are adjusted to at least substantially match the slew rate of the aiming mechanism 110. The modification of the signal in 810 may be accomplished by filtering the signal in an analog manner or by processing the signal in a digital manner. Performing 808 and 810 can correspond to the embodiment of FIG. 7B.

It is noted that, although specific embodiments have been illustrated and described herein, it will be appreciated by those of ordinary skill in the art that any arrangement is calculated to achieve the same purpose may be substituted for the specific embodiments shown. This application is intended to cover any adaptations or variations of the present invention. Therefore, it is manifestly intended that this invention be limited only by the claims and equivalents thereof.

We claim:

1. A method comprising:

for each of a plurality of sub-frames of a frame of image data, controlling a modulator in accordance with the sub-frame; and, physically adjusting an aiming mechanism to differently aim each sub-frame, such that acoustical noise in physically adjusting the aiming mechanism is reduced, wherein physically adjusting the aiming mechanism to differently aim each sub-frame comprises one of:

providing a signal in accordance with which the aiming mechanism is physically adjusted, the signal having a waveform corresponding to reduced acoustical noise; or, modifying the signal in accordance with which the aiming mechanism is physically adjusted to reduce acoustical noise in physically adjusting the aiming mechanism.

2. The method of claim 1, wherein physically adjusting the aiming mechanism to differently aim each sub-frame comprises providing the signal in accordance with which the aiming mechanism is physically adjusted, the signal having a waveform corresponding to reduced acoustical noise.

3. The method of claim 2, wherein providing the signal comprises providing the signal having the waveform in which a transition between a low portion of the waveform and a high portion of the waveform is no greater than a slew rate of the aiming mechanism.

4. The method of claim 2, wherein providing the signal comprises providing the signal having the waveform in which a transition between a low portion of the waveform and a high portion of the waveform at least substantially matches a slew rate of the aiming mechanism.

5. The method of claim 2, wherein providing the signal comprises providing the signal having the waveform in which corners of the waveform are softened.

6. The method of claim 5, wherein providing the signal having the waveform in which the corners of the waveform are softened comprises providing the signal having the waveform in which the corners of the waveform are smoothed, rounded, or cut off.

7. The method of claim 1, wherein physically adjusting the aiming mechanism to differently aim each sub-frame comprises modifying the signal in accordance with which the aiming mechanism is physically adjusted to reduce acoustical noise in physically adjusting the aiming mechanism.

8. The method of claim 7, wherein modifying the signal comprises one of filtering the signal in an analog manner and processing the signal in a digital manner to reduce acoustical noise in physically adjusting the aiming mechanism.

9. The method of claim 7, wherein modifying the signal comprises adjusting a transition of a waveform of the signal so that a transition between a low portion of the waveform and a high portion of the waveform is no greater than a slew rate of the aiming mechanism.

10. The method of claim 7, wherein modifying the signal comprises adjusting a transition of a waveform of the signal so that a transition between a low portion of the waveform and a high portion of the waveform at least substantially matches a slew rate of the aiming mechanism.

11. The method of claim 7, wherein modifying the signal comprises softening corners of a waveform of the signal.

12. The method of claim 11, wherein softening the corners of the waveform of the signal comprises smoothing, rounding, or cutting off the corners of the waveform of the signal.

13. A method comprising:

for each of a plurality of sub-frames of a frame of image data, controlling a modulator in accordance with the sub-frame; and, providing a signal to physically adjust an aiming mechanism to differently aim each sub-frame, wherein the signal has a waveform in which a transition between a low portion of the waveform and a high portion of the waveform is no greater than a slew rate of the aiming mechanism, and in which corners of the waveform are softened, and wherein the transition between the low portion of the waveform and the high portion of the waveform at least substantially matches the slew rate of the aiming mechanism.

14. The method of claim 13, wherein the corners of the waveform are smoothed, rounded, or cut off.

15. A method comprising:

for each of a plurality of sub-frames of a frame of image data, controlling a modulator in accordance with the sub-frame;

providing a signal to physically adjust an aiming mechanism to differently aim each sub-frame, the signal having a waveform; and, modifying the signal so that a transition between a low portion of the waveform and a high portion of the waveform is no greater than a slew rate of the aiming mechanism, and so that corners of the waveform are smoothed, wherein modifying the signal comprises modifying the signal so that the transition between the low portion of the waveform and the high portion of the waveform at least substantially matches the slew rate of the aiming mechanism.

16. The method of claim 15, wherein modifying the signal further comprises one of filtering the signal in an analog manner and processing the signal in a digital manner.

17. An aiming sub-system for a display device in which a modulator is controlled in accordance with each of a plurality of sub-frames of a frame of image data, comprising:

an aiming mechanism to differently aim each sub-frame of the frame of the image data; and, a controller to physically adjust the aiming mechanism such that acoustical noise in physically adjusting the aiming mechanism is reduced, wherein the aiming mechanism comprises one of a reflective aiming mechanism or a refractive aiming mechanism.

18. The aiming sub-system of claim 17, wherein the controller comprises a signal generator to generate a signal in accordance with which the aiming mechanism is physical adjusted.

19. The aiming sub-system of claim 18, wherein the signal has a waveform comprising at least one of:

a transition between a low portion of the waveform and a high portion of the waveform that is no greater than a slew rate of the aiming mechanism;

softened corners;

smoothed corners;

cut-off corners; and, rounded corners.

20. The aiming sub-system of claim 19, wherein the transition between the low portion of the waveform and the high portion of the waveform at least substantially matches the slew rate of the aiming mechanism.

21. The aiming sub-system of claim 18, wherein the controller further comprises a signal-modification mechanism to modify the signal such that a waveform of the signal comprises at least one of:

a transition between a low portion of the waveform and a high portion of the waveform that is no greater than a slew rate of the aiming mechanism;

softened corners;

smoothed corners;

cut-off corners; and, rounded corners.

22. The aiming sub-system of claim 21, wherein the transition between the low portion of the waveform and the high portion of the waveform at least substantially matches the slew rate of the aiming mechanism.

23. The aiming sub-system of claim 21, wherein the signal-modification mechanism comprises one of an analog filter and a digital signal processor (DSP).

24. An aiming sub-system for a display device in which a modulator is controlled in accordance with each of a plurality of sub-frames of a frame of image data, comprising:

first means for differently aiming each sub-frame of the frame of the image data; and, second means for physically adjusting the first means such that acoustical noise in physically adjusting the first means is reduced, wherein the second means is for providing a signal in accordance with which the first means is physically adjusted, the signal having a waveform comprises at least one of:

a transition between a low portion of the waveform and a high portion of the waveform that is no greater than a slew rate of the first means;

softened corners;

smoothed corners;

cut-off corners; and, rounded corners.

25. The aiming sub-system of claim 24, wherein the second means is for adjusting the signal in accordance with which the first means is physically adjusted, the signal having a waveform comprises at least one of:

a transition between a low portion of the waveform and a high portion of the waveform that is no greater than a slew rate of the first means;

softened corners;

smoothed corners;

cut-off corners; and, rounded corners.

* * * * *

UNITED STATES PATENT AND TRADEMARK OFFICE

CERTIFICATE OF CORRECTION

PATENT NO. : 7,586,503 B2
APPLICATION NO. : 11/193888
DATED : September 8, 2009
INVENTOR(S) : Stan E. Leigh et al.

It is certified that error appears in the above-identified patent and that said Letters Patent is hereby corrected as shown below:

In column 10, line 13, in Claim 23, delete "of" and insert -- of: --, therefor.

Signed and Sealed this

Sixth Day of July, 2010

David J. Kappos

David J. Kappos
*Director of the United States Patent and Trademark Office*